US005949180A

United States Patent [19]

Walker

[11] Patent Number: 5,949,180

[45] Date of Patent: Sep. 7, 1999

[54] LAMP APPARATUS WITH REFLECTIVE CERAMIC SLEEVE HOLDING A PLASMA THAT EMITS LIGHT

[75] Inventor: Dale S. Walker, Houston, Tex.

[73] Assignee: Fusion Lighting, Inc., Rockville, Md.

[21] Appl. No.: 08/771,723

[22] Filed: Dec. 20, 1996

[51] Int. Cl.[6] ..... H01J 5/16; H01J 61/40; H01J 17/16; H01J 61/30

[52] U.S. Cl. ..... 313/113; 313/634; 313/631; 313/234; 313/491; 313/492; 313/493; 313/110; 313/17

[58] Field of Search ..... 313/17–18, 21, 313/24, 25–27, 478, 488, 493, 110, 113, 634, 586, 589, 590, 594, 637, 256, 39, 234, 607, 631, 492, 491

[56] References Cited

U.S. PATENT DOCUMENTS

| | | | |
|---|---|---|---|
| Re. 21,823 | 6/1941 | Burns | 313/25 |
| 3,384,771 | 5/1968 | Pomfrett | 313/25 |
| 4,071,798 | 1/1978 | Hammond | 313/18 |
| 4,517,491 | 5/1985 | Otto et al. | 313/579 |
| 4,678,960 | 7/1987 | Reiling | 313/25 |
| 4,791,333 | 12/1988 | Morris et al. | 313/113 X |
| 4,866,327 | 9/1989 | Fischer et al. | 313/25 |
| 4,870,316 | 9/1989 | Otani | 313/25 |
| 4,949,003 | 8/1990 | Cox et al. | 313/25 |
| 5,093,601 | 3/1992 | Watanabe et al. | 313/25 |
| 5,148,085 | 9/1992 | Kroes | 313/27 X |
| 5,153,482 | 10/1992 | Keijser | 313/17 X |

*Primary Examiner*—Sandra O'Shea
*Assistant Examiner*—Mack Haynes

[57] ABSTRACT

A lamp apparatus for producing a beam of light that can be used as a part of a source for a projection system. The lamp apparatus of the present invention produces a beam of light originating from a small aperture. The apparatus includes an electrodeless lamp body in the form of elongated outer tube having a hollow interior. An inner sleeve fits or is deposited inside the outer tube, the inner sleeve having a fill containing generally cylindrically or spherical shaped bore. The sleeve provides temperature resistant and reflection properties. Electrodes positioned either internally or externally of the lamp body are provided for producing radio frequency energy that excite the fill contained in the bore of the inner sleeve to form a plasma light source of intense heat. The light thus generated by the plasma in a relatively large volume is constrained to exit through a small aperture at either one, or both, ends of the apparatus.

43 Claims, 4 Drawing Sheets

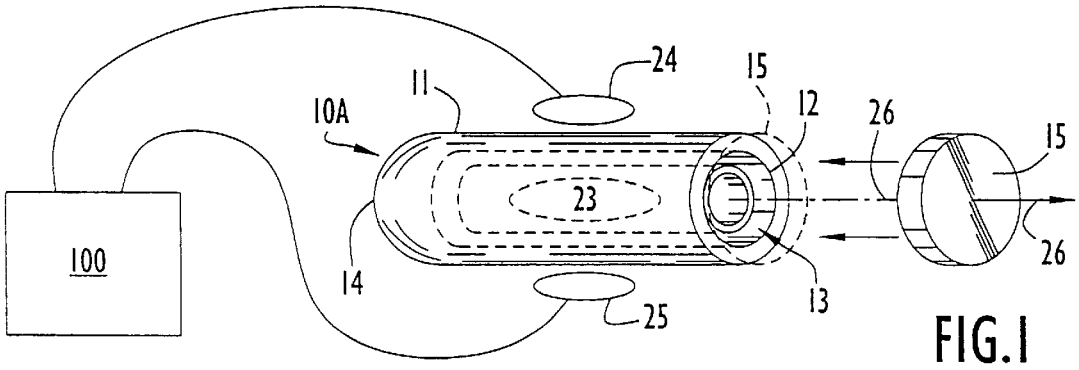
FIG.1
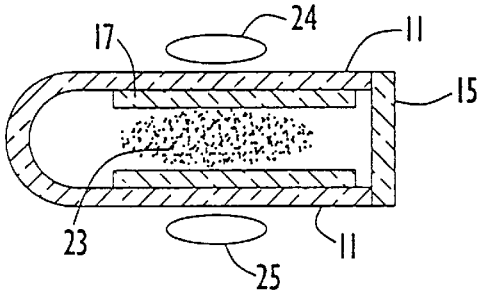
FIG.2
FIG.3
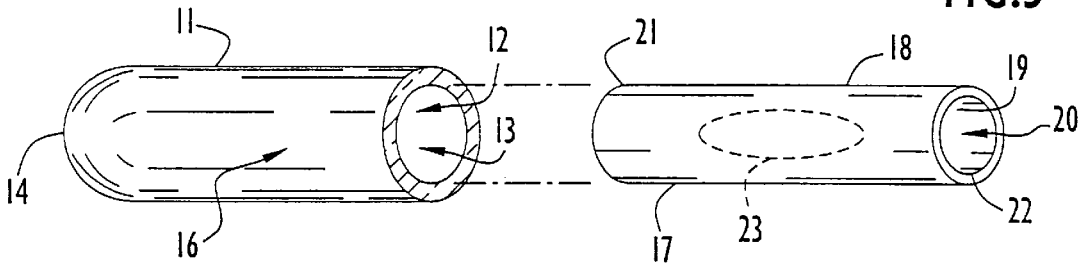
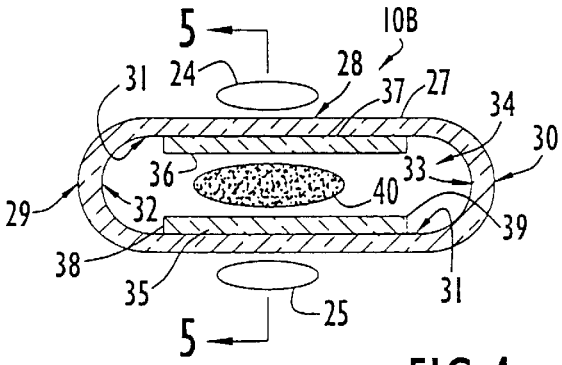
FIG.4
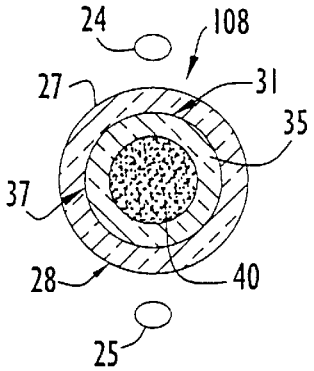
FIG.5

LAMP APPARATUS WITH REFLECTIVE CERAMIC SLEEVE HOLDING A PLASMA THAT EMITS LIGHT

BACKGROUND OF THE INVENTION

1. Field of the Invention

The present invention relates to a high temperature, high efficiency lamp apparatus with an improved configuration that produces a beam of light using a bulb containing a fill that is energized to vaporize the fill. More particularly, the present invention relates to a projecting system that features a lamp in which light energy is generated by a plasma contained inside a cylindrical ceramic sleeve that has a surface with reflecting properties.

2. Description of the Related Art

High power lamps are used for illumination applications beyond typical incandescent and fluorescent lamps. One type of lamp known as a high intensity discharge (HID) lamp consists of a glass envelope and a fill which vaporizes and becomes a gas when the lamp is operated. U.S. Pat. No. 5,404,076, issued to Dolan, et al. and entitled "Lamp Including Sulfur," discloses an electrodeless lamp with a fill of sulfur, selenium, or compounds of these substances. The fill is excited through electromagnetic energy supplied from external electrodes. The Dolan, et al. U.S. Pat. No. 5,404,076 is incorporated herein by reference.

Projecting systems are used to display images on large surfaces, such as computer displays or television screens. For example, in a front projection system, an image beam is projected from an image source onto the front side of a reflection-type angle transforming screen, which then reflects the light toward a viewer positioned in front of the screen. In a rear projection system, the image beam is projected onto the rear side of a transmission-type angle transforming screen and transmitted toward a viewer located in front of the screen.

Prior co-pending U.S. patent application Ser. No. 08/581,108, entitled "Projecting Images," to Knox, filed Dec. 29, 1995, discloses a method of displaying an optical image by projecting the image along an optical path and at an optical device interposed across the optical path, at one time reflecting the image from the optical device and at a different time permitting the image to pass through the optical device to be displayed. U.S. application Ser. No. 08/581,108, entitled "Projecting Images," to Knox, filed Dec. 29, 1995, is incorporated herein by reference.

The image source for such projection systems employs a light that must be of high intensity and preferably produced very efficiently. Further, the light is preferably provided from a very small aperture, as close to being a "point source" as possible. If an optical image is to being displayed by projection, it sometimes passes through an optical device interposed across the optical path. In the projection system of prior co-pending U.S. application Ser. No. 08/581,108, filed Dec. 29, 1995, one or more optical devices reflect the image at one time from the optical device and at a different time permit the image to pass through the optical device to be displayed. There will be a decrease in light intensity once the optical image strikes the optical device interposed across the optical path. Therefore, in projection systems where an optical device is interposed across the optical path there is a need for a projection engine with a high intensity light of improved efficiency. U.S. patent application Ser. No. 08/747,190, entitled "High Efficiency Lamp Apparatus for Producing a Beam of Polarized Light," to Knox, et al., filed Nov. 12, 1996, discloses a high efficiency lamp apparatus for producing polarized light. The apparatus redirects reflected light of one polarity back to the light source. U.S. application Ser. No. 08/747,190 is hereby incorporated by reference.

SUMMARY OF THE INVENTION

According to the present invention, a high temperature, high efficiency lamp apparatus is provided with an improved configuration that produces light from a small aperture using a bulb containing a fill which may be energized with externally placed electrodes. According to the present invention, the lamp body is in the form of an elongated outer tube having a hollow interior that contains an inner sleeve. The inner sleeve has a fill containing bore. Alternatively, the electrodes could be placed between the sleeve and the outer tube.

The sleeve also provides a reflective surface, either added as a coating or being an intrinsic property of the sleeve. Electrodes are preferably positioned externally of the lamp body for producing electromagnetic energy that can excite the contained fill within the bore of the inner sleeve to form a plasma light source. A light beam is generated by the plasma light source that exits the lamp body via a small aperture in the sleeve bore.

In one embodiment, the light beam generated by the plasma light source exits both ends of the sleeve via the bore. In another embodiment, the sleeve is closed so that the light only exits one end of the bore.

In one embodiment, the sleeve is spaced from the housing. In another embodiment, the sleeve and housing contact one another continuously along the length of the sleeve. In this latter embodiment, the sleeve could be deposited on the interior of the housing.

The sleeve is preferably of a temperature resistant material such as ceramic (either solid or porous) that can withstand the high temperatures generated by a plasma light source of between about 425° C. and 3600° C. While the sleeve should be selected with particular attention to its thermal, reflective, and chemical interactions with the plasma, the housing should withstand the pressure and vacuum requirements associated with the plasma while freely passing the emitted light.

BRIEF DESCRIPTION OF THE DRAWINGS

For a further understanding of the nature and objects of the present invention, reference should be had to the following detailed description, taken in conjunction with the accompanying drawings, in which like parts are given like reference numerals, and wherein:

FIG. 1 is a sectional exploded view of a first embodiment of the apparatus of the present invention;

FIG. 2 is a sectional elevational view of the first embodiment of the apparatus of the present invention;

FIG. 3 is a perspective exploded view of the embodiment of FIGS. 1 and 2;

FIG. 4 is a sectional elevational view of a second embodiment of the apparatus of the present invention;

FIG. 5 is a sectional view taken along lines 5—5 of FIG. 4;

DETAILED DESCRIPTION OF THE PREFERRED EMBODIMENT

Figure 6:
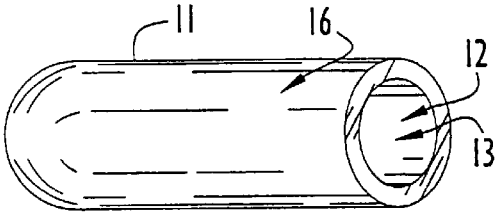
FIG. 6 is a partial perspective view of an embodiment of the apparatus of the present invention illustrating the outer housing for the embodiment of FIGS. 1–3.

FIGS. 1–3 show the first embodiment of the lamp apparatus of the present invention designated generally by the numeral 10A. Lamp apparatus 10A includes outer housing 11 having bore 12. Bore 12 communicates with inner cylindrical surface 13 of housing 11. Housing 11 has closed end 14 portion that is hemispherically shaped. End portion of housing 11 opposite hemispherical end 14 is closed with plate 15 as shown in FIGS. 1 and 2. Housing 11 can have a longitudinally extending cylindrically shaped outer surface 16 in between its end portions as shown in the drawings FIGS. 1–3. The lamp apparatus 10A is shown with a hemispherical end 14. It will be understood that a variety of end portions could instead be used. Some of these are illustrated below in the embodiments of FIGS. 2–13 and 15–16. It may be preferable that the hemispherical end 14 be replaced with other configurations that provide for different optical effects. Alternatives include a plate, a lens, a light pipe, etc. Similarly, the plate 15 could be replaced with a light pipe, hemispherical end, etc. Regarding all of the embodiments of FIGS. 1–13, 15 and 16, it will be appreciated that the variety of features shown in each can in large part be interchanged with the other described embodiments.

Bore 12 holds cylindrically shaped sleeve 17. Sleeve 17 is preferably of a heat resistant material such as ceramic. Sleeve 17 must withstand the high temperatures that are generated by plasma 23 during use. Sleeve 17 has a generally cylindrically shaped outer surface 18 and corresponding inner cylindrically shaped surface 19. Although sleeve 17 must withstand high temperatures, it does not necessarily need to contain pressure or vacuum. Instead, housing 11 should be of a material that can withstand pressure or vacuum, depending on the mode of operation of lamp apparatus 10A.

Sleeve 17 provides cylindrically shaped bore 20 and open end portions 21, 22. During use, plasma 23 is formed within bore 20 of sleeve 17. Bore 12 of housing 11 and bore 20 of sleeve 17 each contain sulfur, selenium, or some other fill material that can be excited to form a plasma 23. A pair of electrodes 24, 25 are positioned externally of outer cylindrical surface 16 of housing 11 as shown in FIGS. 1–2.

Although sleeve 17 is shown with open end portions 21 and 22, as is discussed below in conjunction with the various embodiments, both ends are not necessarily open.

Electrodes 24, 25 provide energy that forms plasma 23. Because electrodes 24, 25 are positioned externally of lamp housing 11, they are not subjected to the very intense heat of plasma 23 during use. Although electrodes 24, 25 are shown external to the lamp apparatus 10A, they can be internal, as discussed below in conjunction with FIGS. 12 and 17. Further, electrodes 24, 25 are shown for conceptual purposes only. The actual configuration of the electrodes would probably be in the form of curved plates, or flat plates, as described in conjunction with FIGS. 14 and 15 below.

In FIG. 1, arrow 26 indicates a beam of light that exits through clear plate 15 and can be used for lighting in a projection type display system. Again, although clear plate 15 is shown, a variety of other optical and mechanical configurations can be used, as is discussed below in the various embodiments. Further, however, the sleeve 17 is preferably made of a ceramic material that not only resists high temperatures, but also provides reflection for light. The ceramic material which forms sleeve 17 is preferably either a specular reflector or, is white or of other color or surface such that light emitted by plasma 23 is reflected or absorbed and reemitted, maintaining high efficiency. In this way, the light from plasma 23 ultimately exits through open end portion 22. A reflector could be positioned behind the open end portion 21, for example, to cause light emitted from that end to be reflected back through bore 20. Or, the open end portion 21 could instead be closed, as is described in embodiments discussed below. In any case, although plasma 23 occupies a large volume, the light exits through a small surface area formed by the open end portion 22. Generally, projection displays benefit from a point light source, or other light source provided through a small aperture. The use of bore 20 and open end portion 22 results in a better approximation of such a point source.

A radio frequency energy source 100 provides a radio frequency (or other suitable frequency) signal to electrodes 24, 25, which in turn transmit radio frequency energy to the gas in bores 12 and 20. Again, electrodes 24, 25 as shown are generally conceptual, with actual configurations being discussed below in conjunction with FIGS. 14 and 15. Further, other frequencies of energy could be provided, whatever is appropriate to excite the fill to a plasma state forming plasma 23.

Figure 7:
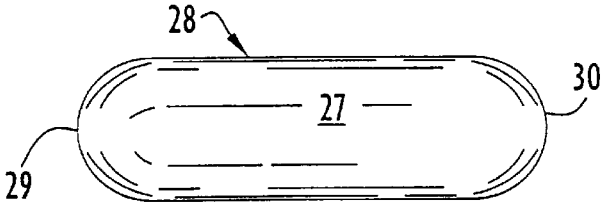
FIG. 7 is a partial perspective view of an embodiment of the apparatus of the present invention illustrating the lamp housing portion of the embodiment of FIGS. 4 and 5.

In FIGS. 4 and 5, a second embodiment of the lamp apparatus of the present invention is shown, designated generally by the numeral 10B. In FIGS. 4 and 5, lamp housing 27 has outer generally cylindrically shaped surface 28 and a pair of opposed end portions 29, 30. Lamp housing 27 has inner generally cylindrically shaped surface 31 and a pair of inner surfaces 32, 33 at opposed end portions of lamp housing 27. Lamp housing 27 provides interior 34 for containing a fill material such as sulfur or selenium or other fill that can be excited to form plasma 40. FIGS. 6 and 7 also show the construction of housings 11 and 27.

Cylindrically shaped heat resistant sleeve 35 is contained within interior 34 of lamp housing 27. Sleeve 35 has a cylindrically shaped inner surface 36, a cylindrically shaped outer surface 37, and opposed open end portions 38, 39.

In the embodiment of FIG. 4, light can be directed in two directions if desired through the ends 29, 30 of lamp housing 27 as shown by arrows 50. As with the embodiment of FIGS. 1–3, plasma 40 is formed using a gas such as sulfur or selenium or other fill contained within interior 34. The contained gas can be excited using electrodes 24, 25 to form plasma 40. Electrodes 24, 25 are positioned externally of outer surface 28 of housing 27 so that electrodes 24, 25 are not subjected to the intense heat of plasma 40.

Figure 9:
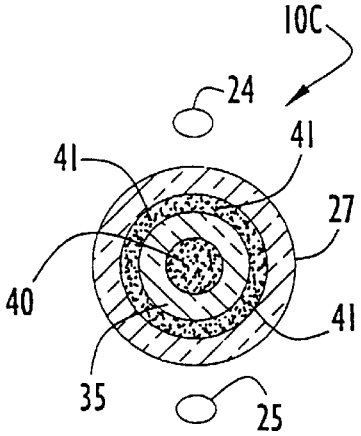
FIG. 9 is a sectional view taken along line 9—9 of FIG. 8.
Figure 8:
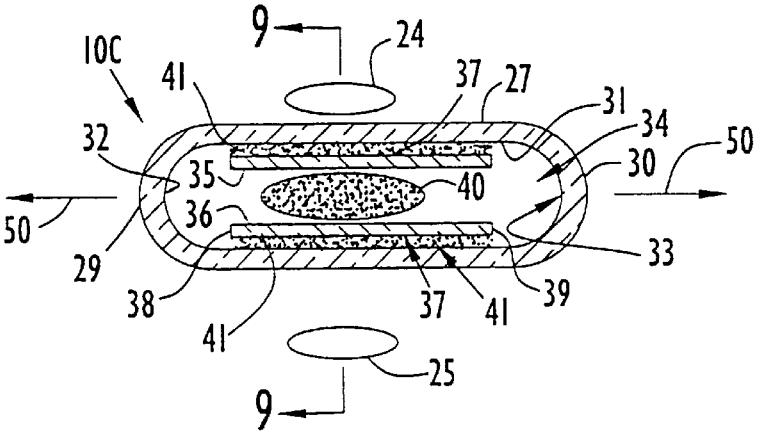
FIG. 8 is a sectional elevational view of a third embodiment of the apparatus of the present invention.

FIGS. 8 and 9 show a third embodiment of the lamp apparatus of the present invention, designated generally by the numeral 10C. In the embodiment of FIGS. 8 and 9, lamp apparatus 10C is similar in construction to the embodiment of FIGS. 4 and 5. However, in FIGS. 8 and 9, a gap 41 is provided in between housing 27 and sleeve 35.

Figure 10:
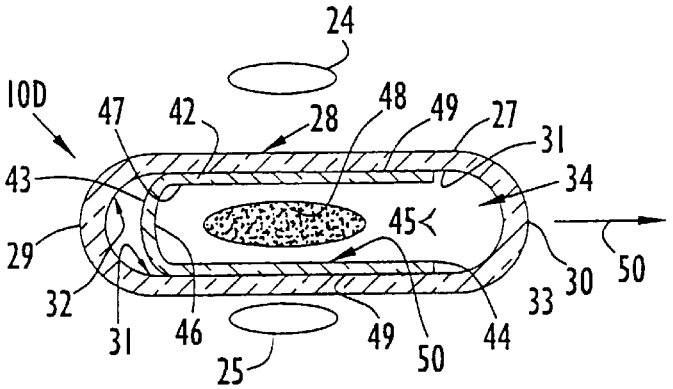
FIG. 10 is a sectional elevational view of a fourth embodiment of the apparatus of the present invention.

In FIG. 10, there is seen a fourth embodiment of the apparatus of the present invention designated generally by the numeral 10D. Lamp apparatus 10D of FIG. 10 is similar to the construction of lamp apparatus 10B of FIGS. 4 and 5, and housing 27 is of the same construction as the housing shown in FIGS. 8 and 9. However, interior 34 of housing 27 carries closed ended sleeve 42 having closed end 43 with a surface 46. The sleeve 42 has open end 45. Interior 34 of housing 27 contains a material such as sulfur that can be excited using electrodes 24 and 25 to form plasma 48.

Sleeve 42 has a generally cylindrically shaped inner surface 47 that extends along the of the length of sleeve 42 as shown in FIG. 10. Sleeve 42 has generally cylindrically shaped outer surface 49 that conforms to, and preferably abuts, the inner surface 31 of housing 27. In the embodiments of FIGS. 8–9 and 10, arrows 50 indicate the direction of light exiting the lamp housing 27.

Figure 11:
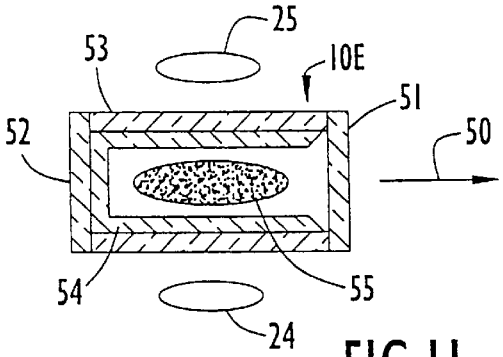
FIG. 11 is a sectional elevational view of a fifth embodiment of the apparatus of the present invention.

Turning to FIG. 11, shown is yet another embodiment 10E of the lamp apparatus according to the invention. Lamp apparatus 10E is similar to the previous embodiments, but is shown to have flat ends 51 and 52, with a cylindrical housing 53. In this embodiment, however, a sleeve 54 is formed by coating all interior sides of cylindrical housing 53 as well as the end portion 52. This could be done with a variety of techniques for depositing ceramics, for example. It will be appreciated that by using ceramic coatings, or coatings of other material, the various embodiments of the lamp apparatus could be similarly constructed. In lamp apparatus 10E, a plasma 55 again causes the emission of light 50.

Figure 12:
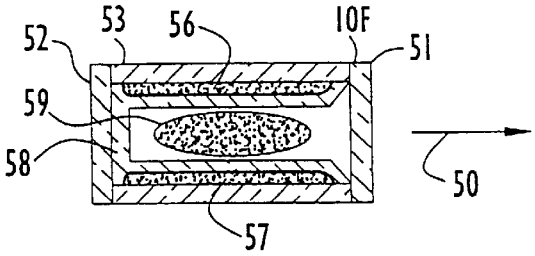
FIG. 12 is a sectional elevational view of a sixth embodiment of the apparatus of the present invention.

Turning to FIG. 12, yet another embodiment 10F of the lamp apparatus according to the invention is shown. This embodiment is similar to lamp apparatus 10E of FIG. 11, employing the same end portions 51 and 52 and the same housing 53. In this embodiment, however, electrodes 56 and 57 are preferably either deposited or placed in the interior of housing 53. Then, a coating 58 is applied over those electrodes 56 and 57, thus protecting electrodes 56 and 57 from the heat of a plasma 59. Similar internal electrodes could be used with other embodiments according to the invention, preferably with the insulating sleeve or coating placed between the electrodes and the plasma.

Figure 13:
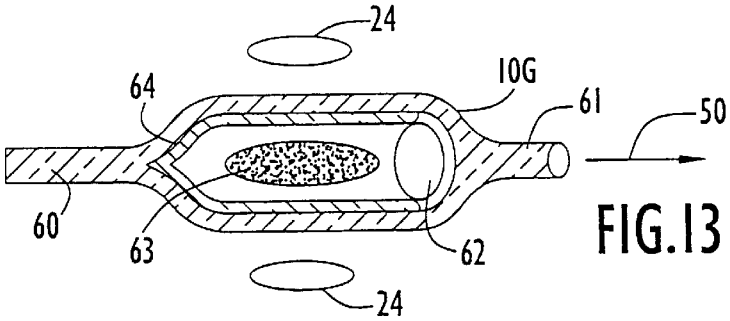
FIG. 13 is a sectional elevational view of a seventh embodiment of the apparatus of the present invention.

Turning to FIG. 13, a lamp apparatus 10G is shown, which in this case has a housing 60 that is formed from drawn glass, rather than being constructed as the previous embodiments. In embodiment 10G, housing 60 includes a light pipe 61 through which light 50 is transmitted. Also enclosed within housing 60 is preferably a lens 62 which focuses light from a plasma 63 onto light pipe 61. Again, lamp apparatus 10G includes an internal coating 64, similar to the internal coatings 54 and 58 of lamp apparatus 10E and lamp apparatus 10F. It will thus be appreciated that a variety of techniques can be used to construct lamp apparatus 10 according to the invention.

Figure 14:
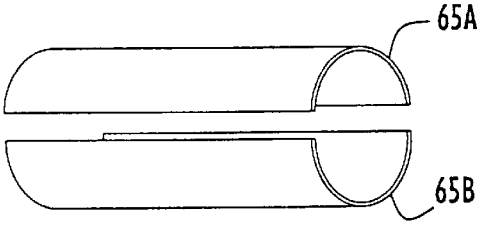
FIGS. 14 and 15 are illustrations of potential configurations of electrodes for use with a lamp according to the invention.
Figure 15:
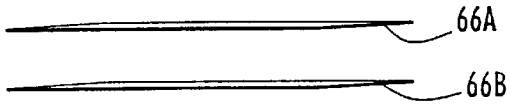

Turning to FIGS. 14 and 15, two sets of electrodes 65A and 65B, and 66A and 66B are shown. These are simply illustrative of appropriate actual configurations for the various electrodes shown in the embodiments of FIGS. 1–13, 16, and 17 and it will be appreciated that a variety of other electrode configurations are possible without detracting from the spirit of the invention.

Thus, in lamp apparatus 10 constructed according to the invention, an internal coating or ceramic sleeve is both heat resistant, insulating, and preferably effectively reflective of the intense light generated by a plasma source. This coating reflects light and protects the housing from high temperature. The housing is then optimized to withstand pressure or vacuum as necessary depending on the state of the plasma. This allows lower temperature materials to be used for the housing, resulting in increased efficiency of light emission. Further, by providing the sleeve, light is internally reflected until emitted from a relatively small aperture at an end of the housing, resulting in more of a point source which is desirable for a number of projection systems.

Figure 16:
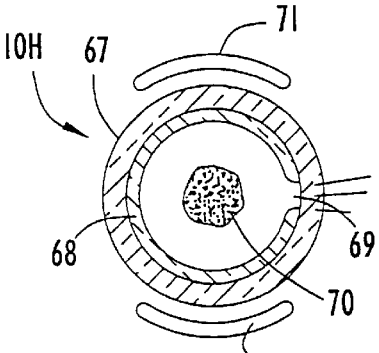
FIGS. 16 and 17 are sectional elevational views of two spherical embodiments of the apparatus of the present invention.
Figure 17:
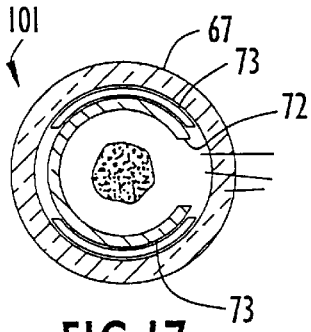

Turning to FIGS. 16 and 17, additional embodiments 10H and 10I are shown, illustrating how different housing shapes can be employed in implementing a lamp according to the invention. In FIG. 16, the lamp apparatus 10H is shown having a housing 67 that is spherical, rather than cylindrical. In the illustrated embodiment, a reflective and thermal controlling coating 68 is provided with an aperture 69, again insulating and protecting housing 67 from a plasma 70. In this particular embodiment 10H, external electrodes 71 are used. The embodiment 10I of FIG. 17 is of similar shape, employing the same housing 67, but instead of coating 68, a formed reflector 72 is employed, with interior electrodes 73 between reflector 72 and housing 67. This illustrates as with embodiments 10A–10G how a variety of shapes and configurations can be used in a lamp apparatus according to the invention.

Figure 18:
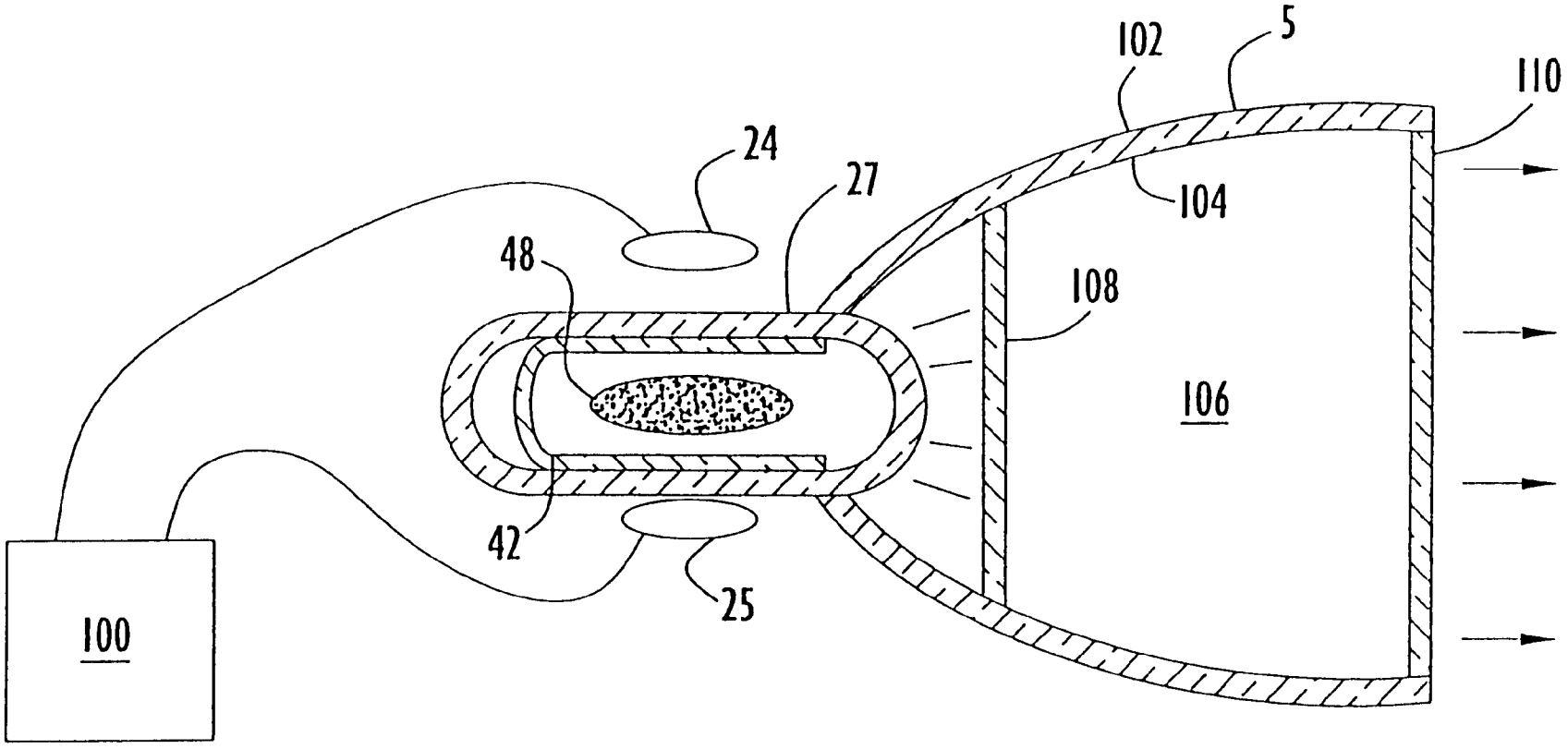
FIG. 18 is a system in which the lamp apparatus according to the present invention may be implemented.

Turning to FIG. 18, a system 5 in which lamp apparatus 10D would preferably be used is illustrated. Housing 27 with close ended sleeve 42 is positioned within the body of a reflector 102 with an inner reflecting surface 104. Light is directed out of the end of housing 27 into an area 106 formed by reflector 102. The high intensity light from housing 27 is transmitted through a reflective interference filter 108, which only passes desired frequencies of light and reflects remaining frequencies back into housing 27, so that preferably that reflected light is reabsorbed by plasma 48 and re-emitted. The selected frequencies of light then pass through a reflective polarizing filter 110, which passes light of a desired polarity and reflects remaining components of light back through mirror 108 and into housing 27, again for reabsorption. This system 5 is preferably used in applications that require polarized light, such as the Projector Lamp Optics Assembly disclosed in copending U.S. patent application Ser. No. 08/730,818, entitled "Image Projection System Engine Assembly," to Knox, filed on Oct. 17, 1996, which is hereby incorporated by reference.

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in a limiting sense.

What is claimed as invention is:

1. A lamp apparatus for producing a beam of light comprising:

a lamp body in the form of an elongated outer housing having a hollow interior;

an inner sleeve inside the outer housing, the inner sleeve having a fill containing bore, wherein the fill forms a plasma which generates light when excited;

the inner sleeve both providing thermal control and a reflective surface; and electrodes positioned external to the outer housing, wherein a light beam formed of the light generated by the plasma exits the lamp body via the sleeve bore.

2. The lamp apparatus of claim 1, wherein the inner sleeve is ceramic.

3. The lamp apparatus of claim 2, wherein the inner sleeve is a porous ceramic container.

4. The lamp apparatus of claim 1, wherein the inner sleeve is of a material that can withstand temperatures of between about 415° C. and 3600° C.

5. The lamp apparatus of claim 1, wherein the outer housing is generally cylindrically shaped.

6. The lamp apparatus of claim 1, wherein the outer housing has a hollow interior that is generally cylindrically shaped.

7. The lamp apparatus of claim 1, wherein the outer housing is generally spherically shaped.

8. The lamp apparatus of claim 1, wherein the outer housing has a hollow interior that is generally spherically shaped.

9. The lamp apparatus of claim 1, wherein the outer housing includes a light pipe extending therefrom.

10. A lamp apparatus for producing a beam of light, comprising:

a lamp body in the form of an elongated outer housing having a hollow interior;

an inner sleeve inside the outer housing, the inner sleeve having a fill containing bore, wherein the fill forms a plasma which generates light when excited;

the inner sleeve both providing thermal control and a reflective surface; and electrodes positioned internal to the outer housing but between the outer housing and the inner sleeves, wherein a light beam formed of the light generated by the plasma exits the lamp body via the sleeve bore.

11. The lamp apparatus of claim 1, wherein the inner sleeve has a reflective coating placed thereon.

12. The lamp apparatus of claim 1, wherein the inner sleeve and outer housing are concentrically placed and spaced apart.

13. The lamp apparatus of claim 12, wherein there is a gaseous space in between the outer housing and the inner sleeve.

14. The lamp apparatus of claim 1, wherein the fill is excited with radio frequency energy.

15. A lamp apparatus for producing a beam of polarized light comprising:

a lamp body in the form of an elongated, generally cylindrically shaped sealed outer member having a hollow interior;

an inner sleeve that fits inside the sealed outer member, the inner sleeve having a bore containing a fill that can be excited to form a plasma; and electrodes positioned external to the outer member, wherein a light beam formed of the light generated by the plasma exits the lamp body adjacent to one end of the sleeve bore.

16. The lamp apparatus of claim 15 further comprising a reflective surface on the sleeve at the sleeve bore.

17. The lamp apparatus of claim 15, wherein the outer member has a spherically shaped portion.

18. The lamp apparatus of claim 15, wherein the inner sleeve is a heat resistant material that can withstand a temperature of at least 425° C.

19. The lamp apparatus of claim 15, wherein the inner sleeve is of a ceramic material.

20. The lamp apparatus of claim 15, wherein the outer member has a hollow interior that is generally cylindrically shaped.

21. The lamp apparatus of claim 15, wherein the outer member has a hollow interior that is generally spherically shaped.

22. The lamp apparatus of claim 15, wherein the outer member includes a light pipe extending therefrom.

23. A lamp apparatus, comprising:

a lamp body in the form of an elongated, generally cylindrically shaped sealed outer member having a hollow interior;

an inner sleeve that fits inside the sealed outer member, the inner sleeve having a bore containing a fill that can be excited to form a plasma; and electrodes positioned internal to the outer member but between the outer member and the inner sleeve, wherein a light beam formed of the light generated by the plasma exits the lamp body adjacent to one end of the sleeve bore.

24. The lamp apparatus of claim 15, wherein the inner sleeve has two open end portions that can transmit light beams in opposite respective directions.

25. The lamp apparatus of claim 15, wherein inner sleeve and outer member continuously abut along the length of the inner sleeve.

26. The lamp apparatus of claim 15, wherein the outer member has at least one closed flat end portion.

27. The lamp apparatus of claim 15, wherein the inner sleeve has a flat closed end portion.

28. The lamp apparatus of claim 15, wherein the outer member is spaced radially away from the inner tube along the length of the inner sleeve.

29. A system for providing light, comprising:

an energy source providing electromagnetic energy; and a lamp, comprising:

a lamp body in the form of an elongated outer tube having a hollow interior; and an inner sleeve that fits inside the outer tube, the inner sleeve having a fill containing bore, wherein the fill forms a plasma which generates light when excited, wherein a light beam formed of the light generated by the plasma exits the lamp body via the sleeve bore, and electrodes positioned external to the outer tube, wherein said electrodes receive the electromagnetic energy from said energy source.

30. The system of claim 29 further comprising:

a reflector situated adjacent said lamp for directing the light from said lamp.

31. The system of claim 30, further comprising:

a reflective filter situated in said reflector for passing light with desired properties and reflecting light with non-desired properties back to said lamp.

32. The system of claim 29, wherein the inner sleeve is ceramic.

33. The system of claim 29, wherein the outer tube includes a light pipe extending therefrom.

34. A system for providing light, comprising:

an energy source providing electromagnetic energy; and a lamp, comprising:

a lamp body in the form of an elongated outer tube having a hollow interior; and an inner sleeve that fits inside the outer tube, the inner sleeve having a fill containing bore, wherein the fill forms a plasma which generates light when excited, wherein a light beam formed of the light generated by the plasma exits the lamp body via the sleeve bore, and electrodes positioned internal to the outer tube but between the outer tube and the inner sleeve, wherein said electrodes receive the electromagnetic energy from said energy source.

35. The system of claim 29, wherein the inner sleeve is of a material that can withstand temperatures of between 425° C. and 3600° C.

36. The system of claim 29, wherein the outer tube is generally cylindrically shaped.

37. The system of claim 29, wherein the outer tube has a hollow interior that is generally cylindrically shaped.

38. The system of claim 29, wherein the outer tube is generally spherically shaped.

39. The system of claim 29, wherein the outer tube has a hollow interior that is generally spherically shaped.

40. The system of claim 29, wherein the inner sleeve has a reflective coating thereon.

41. The system of claim 29, wherein the inner sleeve and outer tube are concentrically placed and spaced apart.

42. The system of claim 41, wherein there is a gaseous space in between the outer tube and the inner sleeve.

43. The system of claim 29, wherein the electromagnetic energy is radio frequency energy.

* * * * *